US007721920B2

(12) United States Patent
Ruiz De Gopegui et al.

(10) Patent No.: US 7,721,920 B2
(45) Date of Patent: May 25, 2010

(54) ERGONOMIC CAP FOR PLASTIC AEROSOL CONTAINER

(75) Inventors: Ricardo Ruiz De Gopegui, Dublin, CA (US); Katie K. Chow, Daly City, CA (US); Andreas Nguyen, Dublin, CA (US); Doris S. Shieh, Santa Clara, CA (US)

(73) Assignee: The Clorox Company, Oakland, CA (US)

( * ) Notice: Subject to any disclaimer, the term of this patent is extended or adjusted under 35 U.S.C. 154(b) by 146 days.

(21) Appl. No.: 11/421,213

(22) Filed: May 31, 2006

(65) Prior Publication Data

US 2007/0278253 A1 Dec. 6, 2007

(51) Int. Cl.
*B65D 83/00* (2006.01)

(52) U.S. Cl. ..... 222/402.13; 222/182; 222/153.11; 222/402.1

(58) Field of Classification Search ..... 222/402.1, 222/394, 402.13, 402.22, 402.23, 182, 321.8, 222/153.1, 153.11
See application file for complete search history.

(56) References Cited

U.S. PATENT DOCUMENTS

| | | | | |
|---|---|---|---|---|
| 3,039,659 | A * | 6/1962 | Sagarin | 222/402.13 |
| 3,109,565 | A * | 11/1963 | Kutik | 222/402.11 |
| 3,278,086 | A * | 10/1966 | Clouzeau et al. | 222/135 |
| 3,494,510 | A * | 2/1970 | Rahn | 222/153.07 |
| 3,933,283 | A * | 1/1976 | Hoagland | 222/402.13 |
| 5,152,411 | A | 10/1992 | Pope et al. | |
| 5,199,615 | A | 4/1993 | Downing et al. | |
| 5,553,753 | A | 9/1996 | Abpanap | |
| 5,585,125 | A | 12/1996 | Iizuka et al. | |
| 5,888,598 | A | 3/1999 | Brewster et al. | |
| 6,006,957 | A * | 12/1999 | Kunesh | 222/402.13 |
| 6,176,382 | B1 | 1/2001 | Bazlur Rashid | |
| 6,318,595 | B1 * | 11/2001 | Walters | 222/1 |
| 6,390,326 | B1 | 5/2002 | Hung | |
| 6,394,364 | B1 | 5/2002 | Abplanap | |
| 6,401,990 | B1 * | 6/2002 | Walters et al. | 222/547 |
| 6,491,187 | B2 | 12/2002 | Walters | |
| 6,601,735 | B2 * | 8/2003 | Milian et al. | 222/153.11 |
| 6,702,978 | B1 | 3/2004 | Kuehn | |
| 6,884,382 | B2 | 4/2005 | Lynch et al. | |
| 7,017,785 | B2 * | 3/2006 | Lasserre et al. | 222/402.13 |
| 7,028,866 | B2 * | 4/2006 | Kunesh et al. | 222/402.1 |
| 7,036,691 | B2 * | 5/2006 | Nicolas | 222/321.6 |
| 7,104,427 | B2 * | 9/2006 | Pericard et al. | 222/402.13 |

(Continued)

FOREIGN PATENT DOCUMENTS

| | | |
|---|---|---|
| WO | WO03097484 | 11/2003 |

(Continued)

*Primary Examiner*—Frederick C. Nicolas
(74) *Attorney, Agent, or Firm*—Alok Goel

(57) ABSTRACT

A cap is provided for coupling with a pressure-resistant container to form an aerosol spray bottle. The cap includes a spray trigger for controlling a valve. The cap can have an outward slant from the cap bottom where the cap couples with the container. The top profile of the cap from a side view can have a convex shape. The cap can have a front side where the substance is expelled that is higher than the back side where the base of a user's finger would be when the user actuates the trigger with a fingertip.

14 Claims, 12 Drawing Sheets

U.S. PATENT DOCUMENTS

2001/0045434 A1 11/2001 Tsai
2003/0078870 A1* 4/2003 Datar et al. ..... 705/36
2003/0215399 A1 11/2003 Smith et al.
2003/0215400 A1 11/2003 Schroeder et al.
2004/0149781 A1 8/2004 Kunesh et al.
2004/0166266 A1 8/2004 de Wit
2005/0060953 A1 3/2005 Altonen et al.

FOREIGN PATENT DOCUMENTS

WO WO2005/108241 11/2005

* cited by examiner

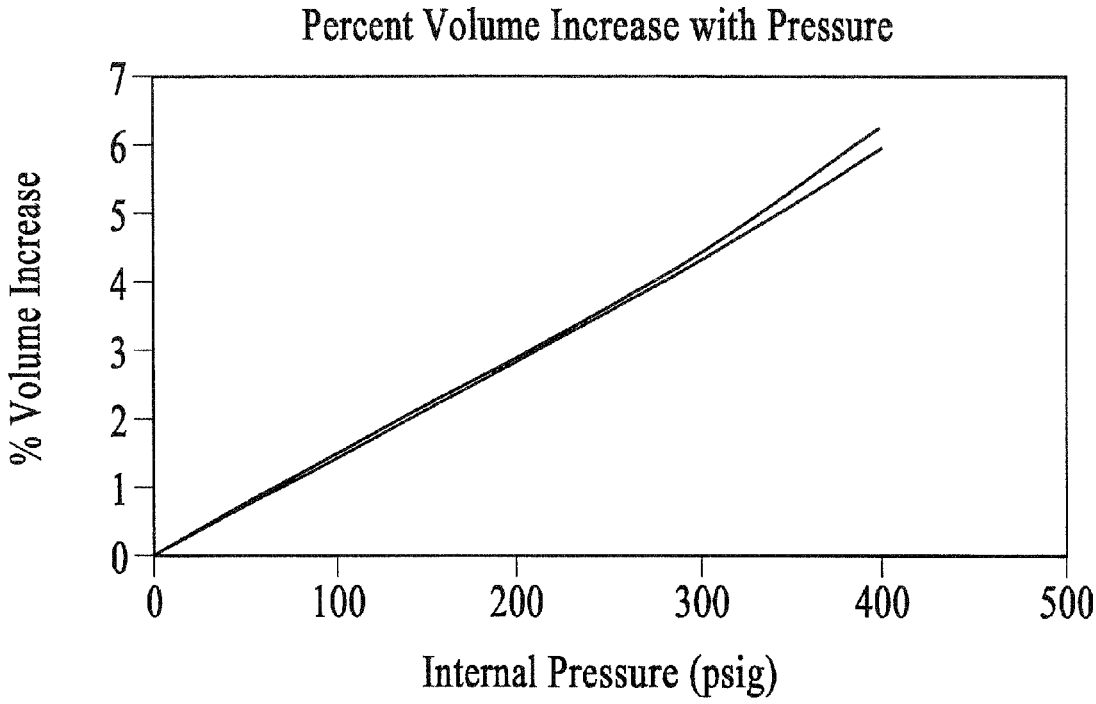
FIG.11
FIG.12
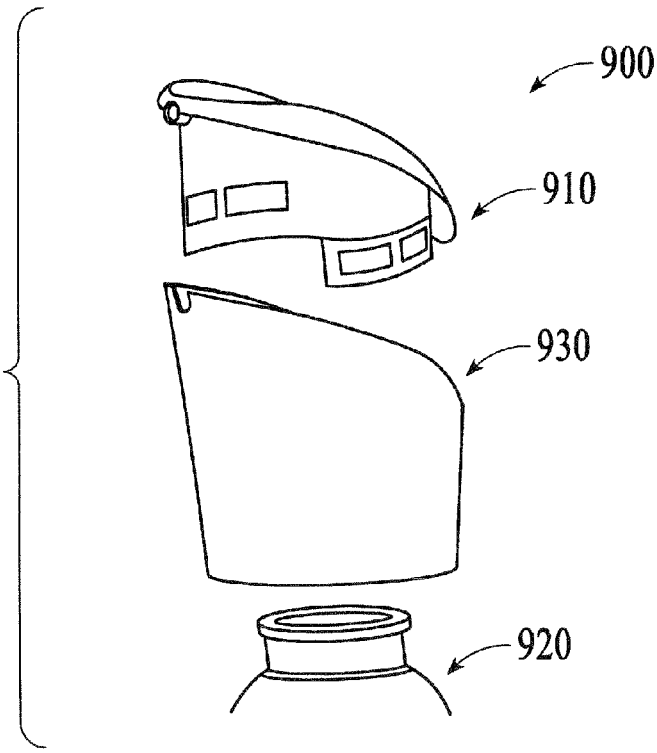

ERGONOMIC CAP FOR PLASTIC AEROSOL CONTAINER

BACKGROUND

The invention relates to a container and cap for an aerosol spray bottle, particularly for an aerosol spray bottle having an ergonomic design.

Spray Bottle Container/Cap Shape

US published patent application No. 2004/0149781 to Kunesh, which is hereby incorporated by reference, describes a pressurized plastic bottle with partially concave sides, a convex shoulder and a convex bottom. FIG. 1 illustrates the design of the 2004/0149781 publication. FIG. 1 illustrates a plastic bottle 1 that comprises a hollow elongate body having a longitudinal axis 2. Bottom portion B includes a bottom portion 6 in the shape of a spherical end defined by a convexly shaped surface, and a side portion 7 in the shape of a spherical segment and having an outwardly convexly shaped surface.

The transition between bottom portion 6 and side portion 7 of the spray bottle of FIG. 1 is defined by a plane extending perpendicular to axis 2 and is represented by line 31. Top portion T has a circular cross-sectional configuration taken through a plane perpendicular to longitudinal axis 2 and has an outwardly convex configuration extending along its longitudinal direction from a point where it merges with central portion C, i.e. line 29 to a point where a neck is formed. Midway between its length, i.e. between central portion C and neck, top portion T has a flat section 18 having a constant circular cross-section extending along its longitudinal direction to define a cylindrical configuration. It is desired to have a spray bottle container having an improved design, preferably in combination with an improved cap design. It is desired for the improved container to have an ergonomic shape for better handling and application of pressurized substances, and particularly dilute hypochlorite substances.

Spray Bottle Cap and Actuator

Cap member 21 of the spray bottle of FIG. 1 has a top circular planar support surface 22 and a depending skirt 23 which is used to cover and surround neck and closure. An actuator including a push button 24 hingedly mounted on skirt 23 is operatively associated with valve stem to activate a valve member and dispense aerosol composition in a conventional manner.

Other conventional designs are illustrated at U.S. Pat. Nos. 5,152,411, 6,491,187 and 5,954,224, and US published application 2003/0215400, and published PCT application No. WO 03.097484, which are hereby incorporated by reference. Typical designs have container walls with straight or convex shapes.

A conventional aerosol cap and actuator is described at US published patent application No. 2005/0218164, which is also incorporated by reference. Referring to FIG. 2, a cap 202 is shown that can be fixed on a conventional pressurized aerosol container (not shown). Cap 202 is composed of a skirt 204 and aerosol actuator button 206 which is joined to outer shell 204 by means of a plastic hinging strip 208. Button 206 contains an actuating means in the form of a depressed finger pad 210 having a number of raised ridges 212. Button 206 also contains an orifice 214 where aerosolized fluid is discharged.

Referring now to FIG. 3 which further illustrates the spray bottle described at the 2005/0218164 published application, when cap 202 is mounted onto an aerosol container, chords 242 engage a bead on the container (not shown) to prevent the cap from sliding off the container. Ribs 240 are mounted on the inner surface of skirt 204. Tubular extension 218 has cavity 220 which runs through the entire extension 218 and is in fluid communication with orifice 214. At its lower end, cavity 220 has a wider portion 226, which sealingly engages the outside of a conventional tubular valve stem (the valve stem which is part of a valve assembly connected to a pressurized can; not shown). The valve stem has a central hollow bore which is in flow communication with cavity 220 and the pressurized liquid in the container. Orifice 214, cavity 220, and the bore hole of the valve stem are all co-axial with the central long axis 230 of button 206.

FIG. 4 illustrates another conventional aerosol container which is described at U.S. Pat. No. 6,394,364, which is also incorporated by reference. Referring to FIG. 4, an aerosol spray dispenser 410 has a thin, flexible plastic outer receptacle 411 for containing a product 412 to be dispensed. Outer receptacle 411 does not contain a pressurized propellant, and accordingly is thin walled.

Seated within outer receptacle 411 is inner receptacle 413 for containing a liquefied propellant 414 having a liquid phase and an overlying gaseous phase. Inner receptacle 413 is substantially rigid to withstand deformation by the propellant. Inner receptacle 413 is closed at its upper end by closure 415 in the form of an aerosol mounting cup as shown in FIG. 4 having a central pedestal portion 416 and a peripheral circumferential channel portion 417. Mounted within pedestal 416 of closure 415 is an aerosol valve assembly 418. The valve assembly 418 includes valve stem 419 and valve housing 420, with the stem 419 extending upwardly through pedestal portion 416. Mounted on the top of valve stem 419 is aerosol actuator 421. Extending downwardly from valve housing 420 within inner receptacle 413 is product conduit 422, which passes through the bottom of inner receptacle 413 and into outer product receptacle 411.

Closure 415 seals inner propellant receptacle 413 by peripheral channel portion 417 being clinched about upper circumferential peripheral bead 423 of inner receptacle 413. In turn the clinched bead 423 and channel 417 rest upon circumferential ledge 424 to seat inner receptacle 413 within outer receptacle 411. The outer periphery of outer receptacle 411 is threaded at the top by threads 425. Cylindrical screw-on plastic cap 426 has a central opening 427 through which actuator 421 and valve stem 419 extend. Cap 426 further has a downwardly extending circular flange 428 which firmly captures the clinched bead 423 and channel 417 between the flange and ledge 424 when the cap 426 is screwed onto the outer plastic receptacle 411.

Further examples are provided at U.S. Pat. Nos. 6,908,017, 6,932,244, and 6,398,082, 6,390,326, 5,888,598, 6,702,978, 5,585,125, 6,884,382, 5,152,411, 6,491,187, 6,394,364, 5,553,753, 5,199,615, and 6,176,382, as well as at US published applications Nos. 2004/0149781, 2005/0060953, 2003/0215400, 2003/0215399, 2001/0045434, and 2004/0166266, which are each incorporated herein by reference. It is desired to have an aerosol spray bottle that has an improved cap, and particularly in combination with an improved container design.

Dilute Hypochlorite Substance within Spray Bottle

A method of diluting hypochlorite is described at US published application No. 2005/0232847. A method for deactivating allergens is described at US published application No. 2005/0214386. A mold system is described at US2005/

0216291, while packaging options are illustrated at US2005/0221113. A multilayer spray bottle is described at US2005/0232848, while a dry hypochlorite is described at US2005/0233900. Each of these references is incorporated by reference. It is desired to have an improved aerosol spray bottle for containing and dispensing a dilute hypochlorite substance.

SUMMARY OF THE INVENTION

A pressure-resistant container is provided for coupling with a cap and an optional base to form an aerosol spray bottle. The cap includes a spray trigger for controlling a valve, while the base is for mounting the container in an upright position. The container has a pressurized substance therein and defines a valve-sealed opening for selectively releasing the pressurized substance from the container by actuating the spray trigger to open the valve. The container is configured such that when the cap is coupled atop the container, exposed outer walls of the container have a continuously concave shape, or a flat portion and a concave portion, at least from a junction of the container with the cap through a gripping portion of the container. When coupled with the optional base, the exposed outer walls of the container are preferably further continuously concave to the junction of the container with the base.

The pressure-resistant container preferably holds a substance at between 50 psi and 200 psi, or between 70 psi and 200 psi, or between 100 psi and 200 psi. The container preferably contains between 1 and 35 fluid ounces, or between 6 and 35 fluid ounces, between 8 and 20 fluid ounces.

The container may advantageously have a shape-change index between 0.3 degrees and 0.7 or 0.8 degrees at 200 psi, or not more than 1.0 degree at 300 psi, or 1.3 degrees at 400 psi. The container may exhibit a percent increase in height of the container due to pressure that is between 0.3% and 0.7% or 1.0% at 200 psi, or not more than 1.1% at 300 psi, or 1.5% at 400 psi. The container may have a characteristic percent increase in volume due to pressure that is between 1% and 3% at 200 psi, or not more than 4.5% at 300 psi or not more than 6% at 400 psi.

The radius of curvature of the exposed concave side walls of the container is preferably between 600 mm and 800 mm. The container has diameters preferably between 20 mm and 150 mm, or between 50 mm and 80 mm. The container may include a grip area in its upper half, which has a diameter between 20 mm and 80 mm, or between 50 mm and 60 mm. The preferred particle size within the pressurized substance is less than approximately 120 μm. A wall thickness of the container is preferably between 0.01 in. and 0.1 in., or between 0.02 in. and 0.1 in. The container may include a shoulder adjacent the opening near the top beneath the cap in the shape of a hemisphere, and with hemisphere base diameter between 20 mm and 80 mm, or between 50 mm and 60 mm. The container may have a shoulder adjacent the opening near the top beneath the cap in the shape of a truncated cone with angle between 15 degrees and 75 degrees, and with base diameter between 20 mm and 80 mm, or between 50 mm and 60 mm.

An aerosol spray bottle is also provided including a cap, a pressure-resistant plastic container and an optional base. The cap includes a spray trigger for controlling a valve. The container has a pressurized substance therein and defines a valve-sealed opening for releasing the substance from the container by actuating the spray trigger to open the valve. The optional base is for mounting the container in an upright position. The container is configured such that when the cap is coupled atop the container, exposed outer walls of the spray bottle have a continuously decreasing diameter from a gripping portion of the cap to at least a junction of the container with the cap. Preferably, the diameter of the exposed outer walls of the spray bottle also does not increase from the junction of the container with the cap at least through a gripping portion of the container.

Alternately, the container is configured such that when the cap is coupled atop the container, the exposed outer walls of the spray bottle comprise a cross-sectional area that does not increase from the junction of the container with the cap through a gripping portion of the container, and the cross-sectional area does increase along some section from the gripping portion of the container to the bottom of the container, and the maximum cross-sectional area of the container from said gripping portion to the bottom of the container is greater than the maximum cross-sectional area from the junction of the container with the cap to the gripping portion. Alternately, the container is configured such that when the cap is coupled atop the container, at least one arbitrary 0.5 inch horizontal section (0.5 inch volumetric slice) of the exposed outer walls of the spray bottle from the junction of the container with the cap through a gripping portion of the container comprises a volume that is not less than the volume for the adjacent 0.5 inch horizontal section below it, and the volume of at least one arbitrary 0.5 inch horizontal section from the gripping portion of the container to the bottom of the container is not greater than the adjacent 0.5 inch section below it, and the maximum cross-sectional area of the container from the gripping portion to the bottom of the container is greater than the maximum cross-sectional area from the junction of the container with the cap to the gripping portion. A container of design 820, but having surface irregularities, such as small horizontal ribs or multiple dimples, would still have at least one arbitrary 0.5 in horizontal section where the volume would not increase.

The exposed outer walls of the spray bottle preferably have a continuously concave shape, or a flat portion and a concave portion, from the junction of the container with the cap and through at least the gripping portion of the container, and the maximum diameter of the container from the gripping portion to the bottom of the container is greater than the maximum diameter from the junction of the container with the cap to the gripping portion. The container of the spray bottle may also be configured advantageously in accordance with the above-mentioned pressure-resistant container, or as otherwise described hereinbelow.

The cap of the spray bottle may have a diameter at its junction with the container that is smaller than an opposing diameter at the top of the spray bottle. Diameters of the cap may vary between 20 mm and 80 mm, or between 50 mm and 60 mm. The cap may have a concave curvature having a radius of curvature between 500 mm and 900 mm. The cap may have a top side with a convex shape. Walls of the cap may have an upside-down truncated cone shape. The cap may have a front side where the substance is expelled that is 3.2 mm to 64 mm higher than the back side where the base of a user's finger is when the user actuates the trigger with a fingertip. The spray trigger may be disposed at the top of the cap opposite the junction of the cap with the container, and the spray trigger may have a substantially flat exposed surface at downward angle between 10 degrees and 60 degrees from horizontal when the bottle is mounted upright. The spray trigger may also include a concave exposed surface having a radius of curvature between 7 mm and 160 mm.

BRIEF DESCRIPTION OF THE DRAWINGS

FIG. 11 shows plots of percent volume increase versus internal pressure for the spray bottles illustrated at FIG. 5.

FIG. 12 shows an exploded view of a two piece cap for an aerosol spray bottle in accordance with a preferred embodiment.

DETAILED DESCRIPTION OF THE PREFERRED EMBODIMENTS

Figure 5:
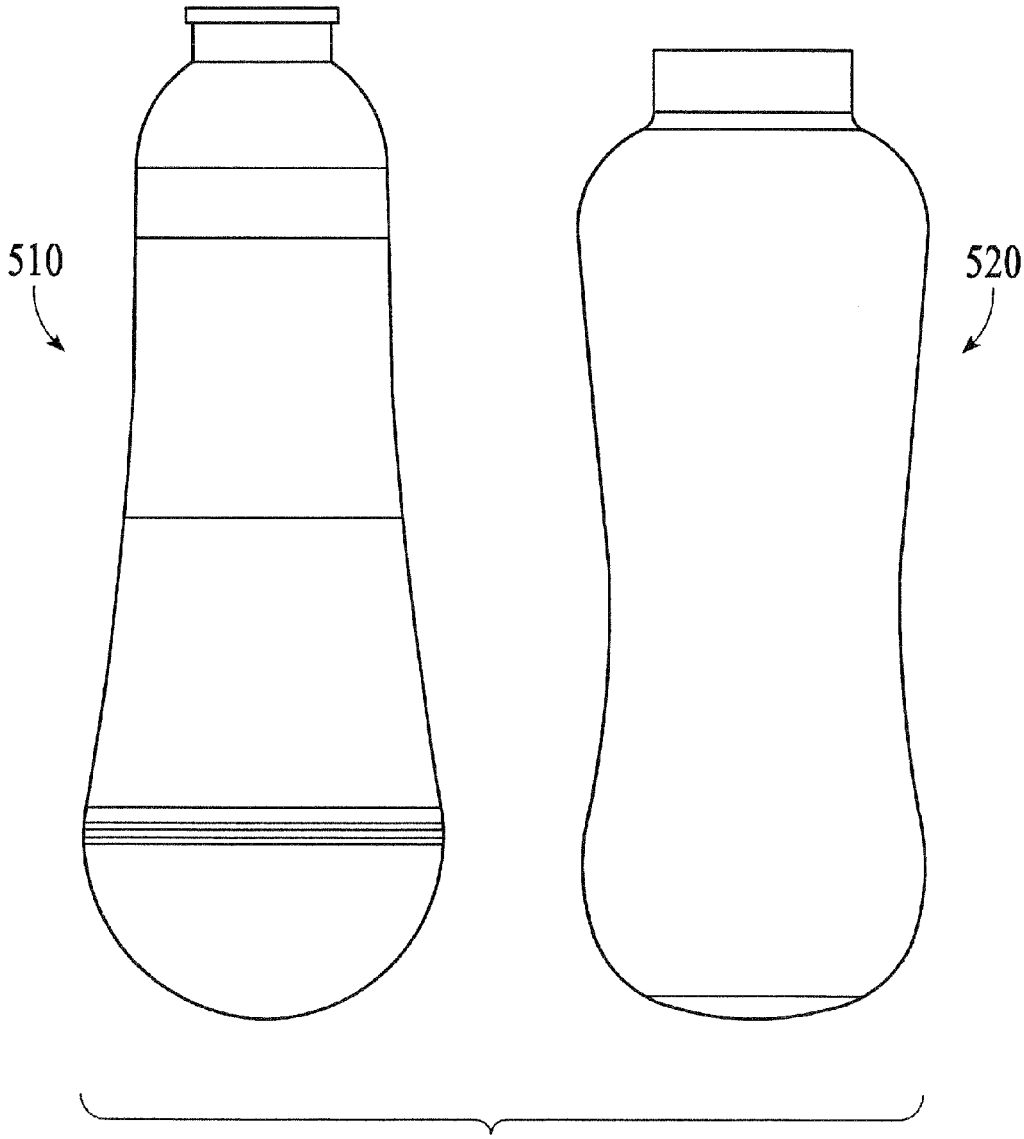
FIG. 5 illustrates a container for an aerosol spray bottle in accordance with a preferred embodiment (left) alongside a conventional container (right).

A plastic aerosol container 510 with concave sidewalls in accordance with a preferred embodiment is shown at left in FIG. 5 alongside a conventional container 520. The concave shape of the container 510 minimizes bulging due to the higher pressure of a substance inside the container 510 compared with ambient pressure. Although not shown in FIG. 5, the preferred aerosol container 510 at left also couples with a unique ergonomic cap that has a wide and smooth concave actuator. The narrower upper portion of the preferred container 510 compared with the container 520 at right in FIG. 5 permits improved handling of the container 510 and ease of spray actuation.

The container 510 at left in FIG. 5 is preferably blow-molded, and may be polypropylene, polyethylene, polyethylene terephthalate, PEN or another plastic. The preferred container 510 is configured preferably to withstand up to 170 to 200 psi burst strength, and has safety requirements sufficient to obtain a DOT safety exemption. Although not shown in FIG. 5, the aerosol cap combined or coupled with container 510 is further advantageous in its design because the diameter of the cap continuously decreases from top to bottom, or at least from a gripping portion to a junction with the container 510 when assembled as a spray bottle with or without a base, or the cap may be said to have outwardly slanting sides, with an inverted angle, based on the orientation indicated at FIG. 5.

Although a circular cross-section is preferred, where the term "diameter" is mentioned regarding a spray bottle in accordance with a preferred or alternative embodiment, it is meant to include a circular or elliptically shaped cap, container and/or base, or any other cross-sectional shape (from a top view of the container at left in FIG. 5) that provides sufficient strength to withstand up to 170 to 200 psi, is readily handled by a user and is moldable. The shape may also change, from circular to elliptical, e.g., from place to place up and down the preferred spray bottle. The diameter indicates the shortest cross-sectional distance.

Figure 13:
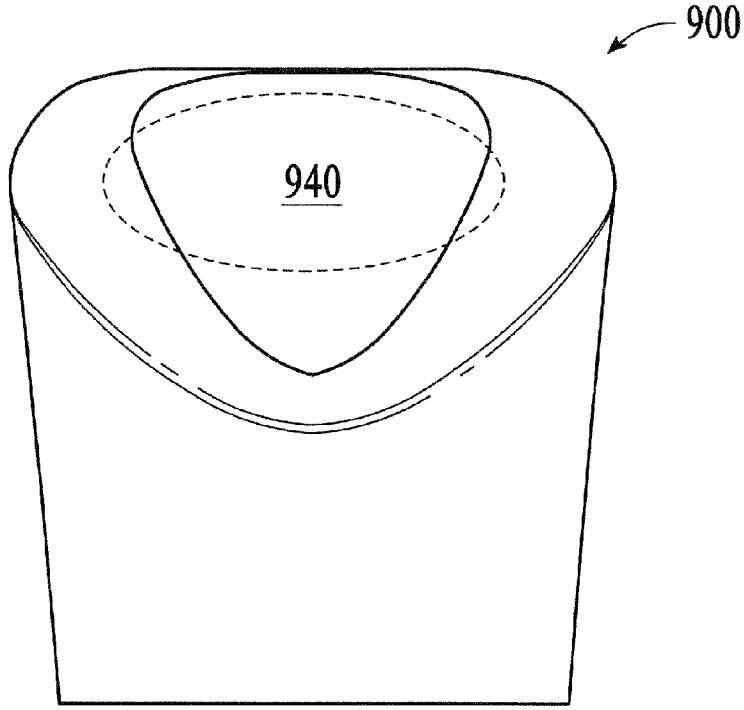
FIG. 13 shows a rear view of a cap for an aerosol spray bottle in accordance with a preferred embodiment.

Because of the decreasing diameter of the cap from at least a gripping portion to its junction with the container 510 (based on the orientation shown in FIG. 5), and alternatively further including a container 510 with a portion that does not increase in diameter from a junction with the cap through a gripping portion, a spray bottle in accordance with a preferred embodiment has a relatively small grip area and a large surface on which to place the actuator at the top of the cap (not shown in FIG. 5, but see FIG. 13). After the gripping portion, the diameter of the container 510 increases preferably to a junction with the base (also not shown, but see FIGS. 8*a*-8*b*) which is at or near the indented ring shown in the container 510 of FIG. 5.

Figure 6A:
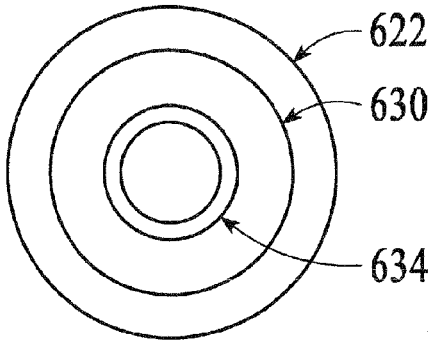
FIGS. 6*a*-6*c* illustrate top, side and perspective views of a container for a spray bottle in accordance with a preferred embodiment.
Figure 6B:
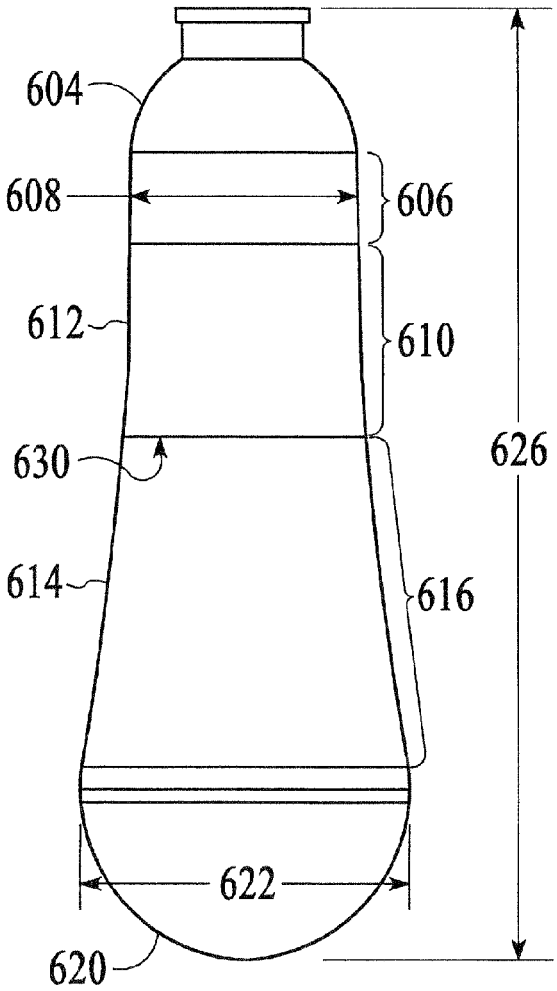
Figure 6C:
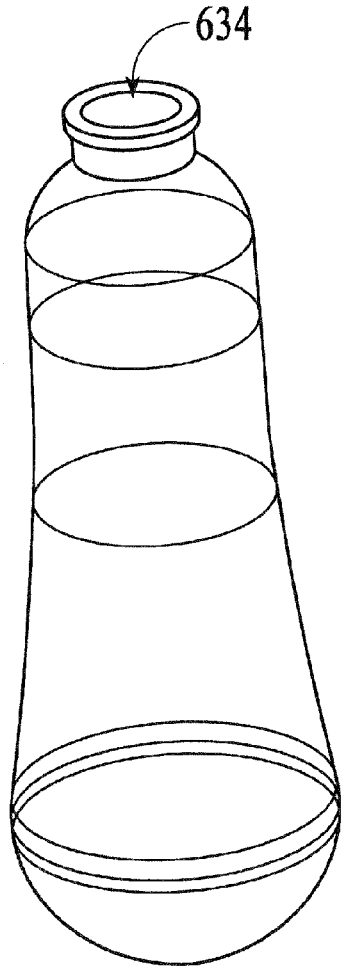

FIGS. 6*a*-6*c* illustrate top, side and perspective views of a container for a spray bottle in accordance with a preferred embodiment. The shoulder 604 has a convex shape with radius of curvature of about 26 mm. The diameter of a flat portion 606 of the container has a non-changing diameter 608 of about 52 mm. A concave portion 610 of the container is just below the flat portion 606 and has a radius of curvature at about its center 612 of around 622 mm. A third portion 616 is also concave and has a radius curvature at its approximate center 614 of about 768 mm. Where the third portion 616 meets a bottom portion 620, the container has a diameter 622 of about 76 mm. The radius of curvature of the bottom portion 620 about half way down is about 38 mm. The height of the container represented schematically at FIG. 6*b* is about 224 mm.

The diameter 630 of the container at about the center is shown in FIGS. 6*a*-6*b* to be larger than the diameter 608 near the top. The diameter 622 near the bottom is also larger than the diameter 630 at the center. The diameter of the opening 634 at the top, which is valve sealed for spray trigger actuation when the spray bottle is assembled, is also shown to be smaller than the diameters 608, 622, 630 of the container at any lower point.

FIGS. 7*a*-7*f* illustrate containers for spray bottles having six different shoulder designs in accordance with alternative embodiments. Each of the designs illustrated in FIGS. 7*a*-7*f* preferably have dimensions as described with respect to FIGS. 6*a*-6*c* above.

Figures 7A, 7B, 7C, 7D, 7E, 7F:
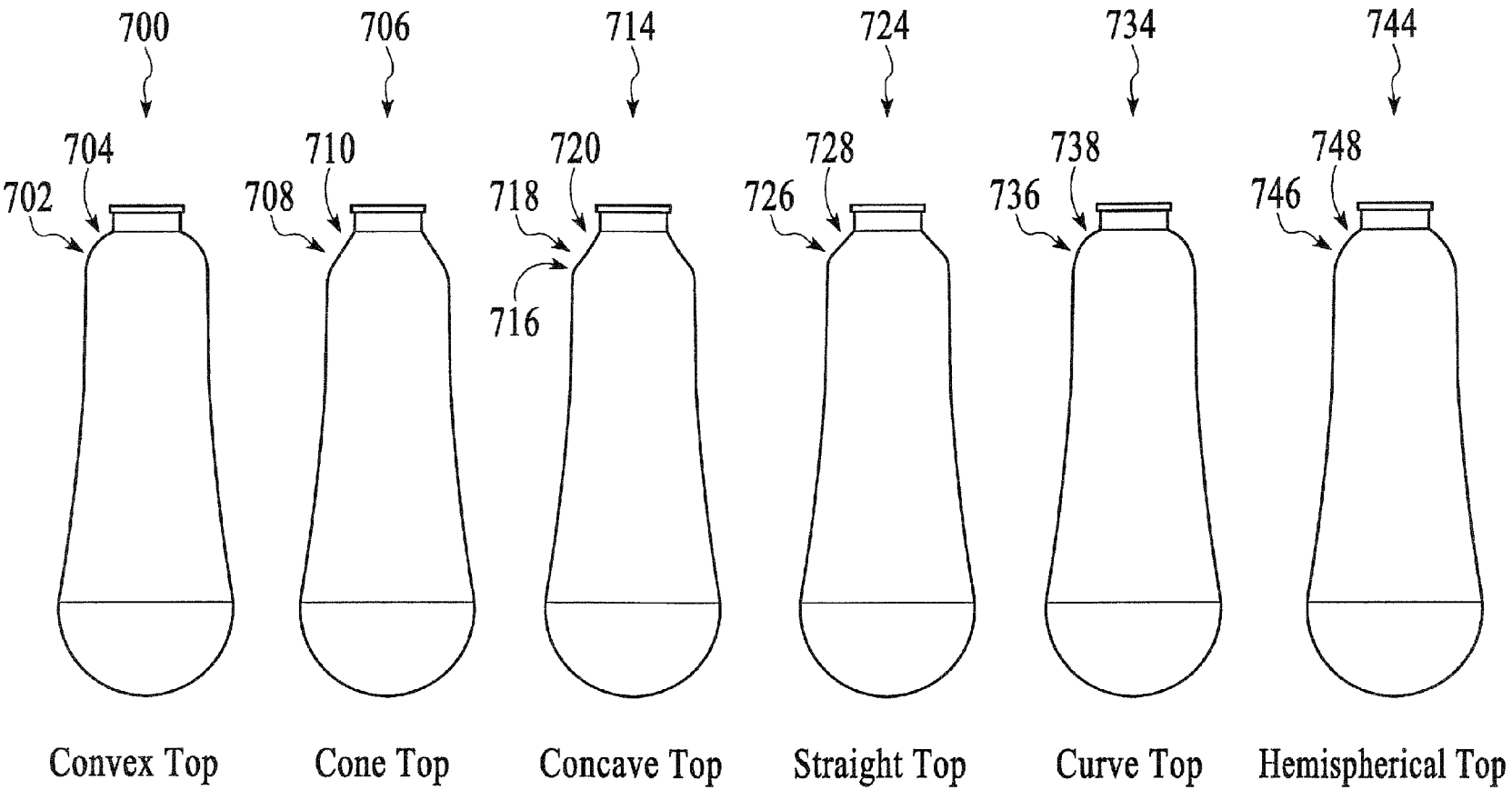
FIGS. 7*a*-7*f* illustrate containers for spray bottles having six different shoulder designs in accordance with alternative embodiments.

FIG. 7*a* illustrates a container 700 having a convex shoulder. The radii of curvature at points 702 and 704 are about 10 mm and 1.6 mm, respectively.

FIG. 7*b* illustrates a container 706 having a truncated cone shaped shoulder. The radii of curvature at the points 708 and 710 are about 10 mm and 5 mm, respectively.

FIG. 7*c* illustrates a container 714 having a concave shoulder. The radii of curvature at points 716, 718 and 720 are about 10 mm, 50 mm and 5 mm, FIG. 7*d* illustrates a container 724 having a straight shoulder. The radii of curvature at points 726 and 728 are about 3 mm and 5 mm, respectively.

FIG. 7*e* illustrates a container 734 having a curved shoulder. The radii of curvature at points 736 and 738 are about 18 mm and 1.6 mm, respectively.

FIG. 7*f* illustrates a container 744 having a hemispherical shoulder. The radii of curvature at points 746 and 748 are about 26.25 mm and 1.6 mm, respectively.

Figure 8A:
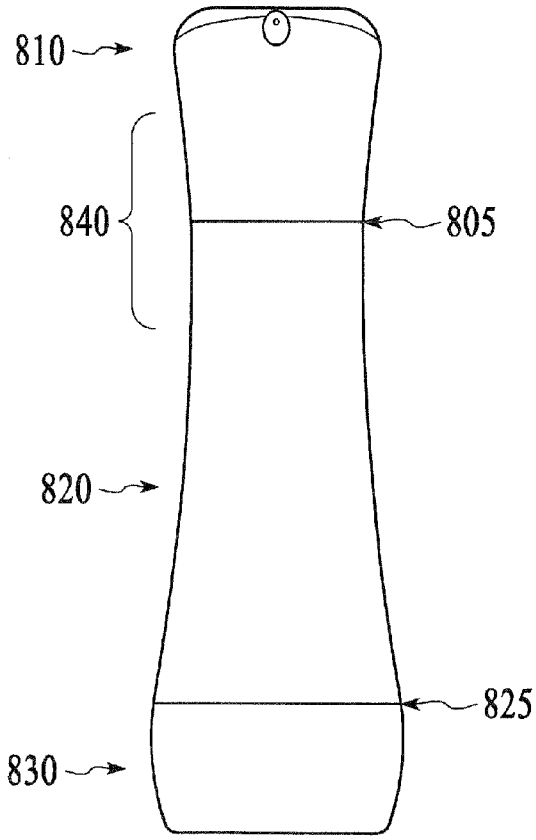
FIG. 8*a* illustrates an assembled spray bottle in accordance with a preferred embodiment.
Figure 8B:
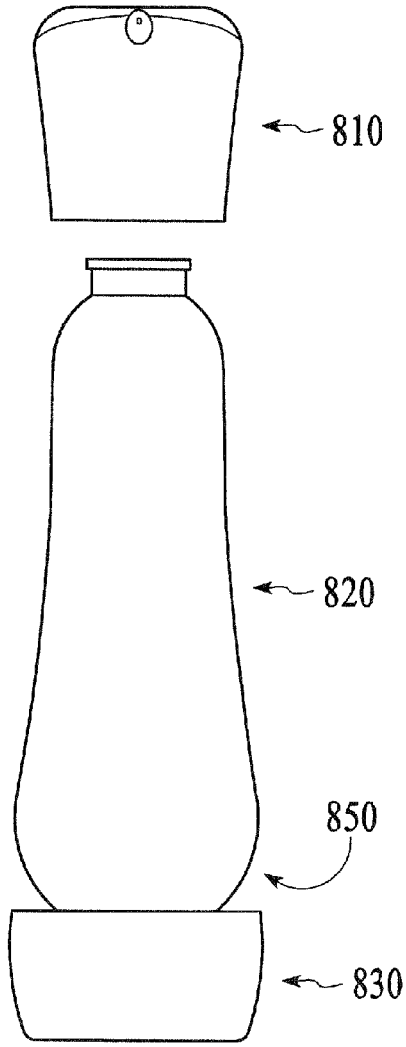
FIG. 8*b* is an exploded view of the spray bottle of FIG. 8*a*.
Figure 8C:
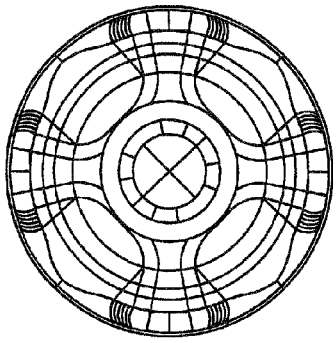
FIGS. 8*c*-8*h* illustrate side, perspective and top views of two alternative embodiments of a pressure resistant container having a petaloid base.
Figure 8D:
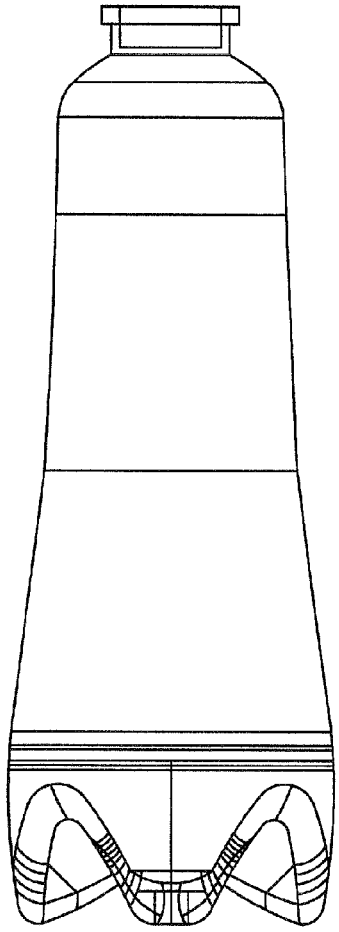
Figure 8E:
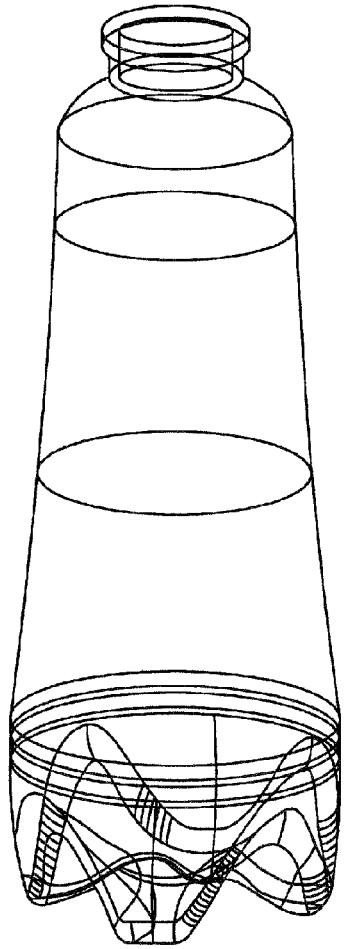
Figure 8F:
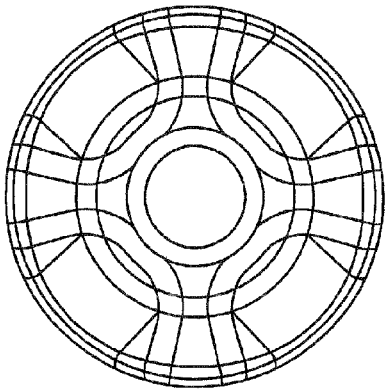
Figure 8G:
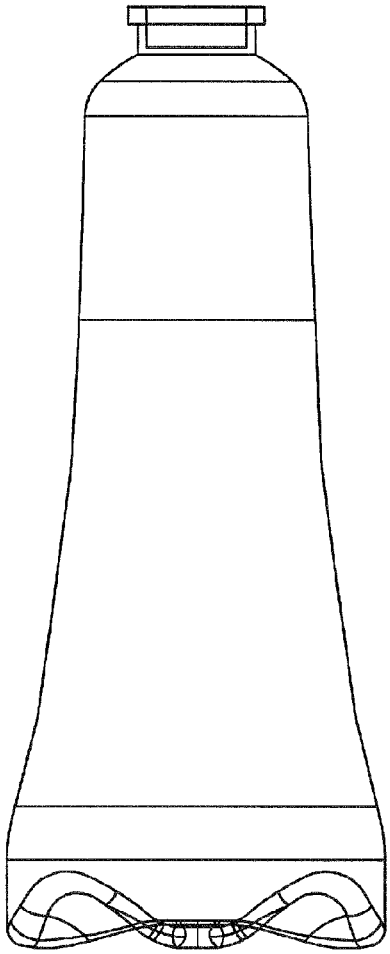
Figure 8H:
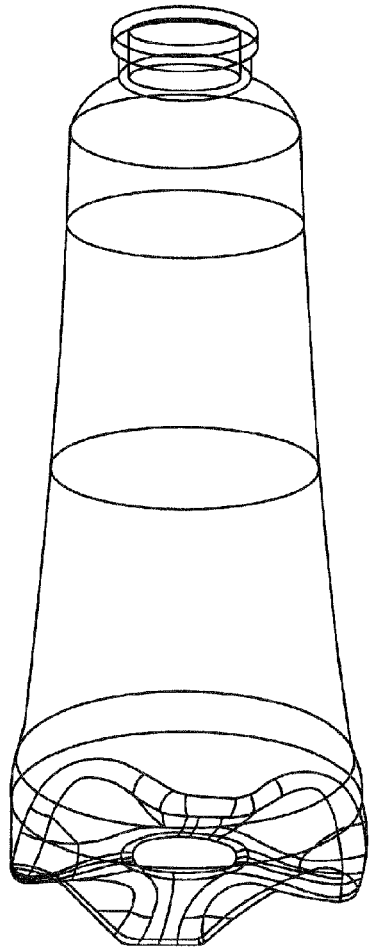

FIG. 8*a* illustrates an assembled spray bottle in accordance with a preferred embodiment, while FIG. 8*b* is an exploded view of the spray bottle of FIG. 8*a*. The container is preferably made of a single or multilayer opaque material having concave sides. The concavity is preferably continuous from a junction 805 of the cap 810 and the container 820 to a junction 825 of the container 820 with the base 830. The cap 810 preferably also has concave outer walls. When the cap 810 is assembled with the container 820, the concave shape is preferably continuous for the spray bottle through the junction 805 and at least through a gripping portion 840 of the spray bottle.

As to a few details, the aerosol spray bottle preferably produces a fine mist over the duration of use of the product. A compressed gas propellant may be used that is stable within the container. Nitrogen gas may be used as a propellant, based on its compatibility with dilute hypochlorite substances, and because it has the lowest permeation rate through Polyethylene Terephthalate (hereinafter "PET"). A balance is maintained for the headspace, nitrogen pressure, and the hypochlorite substance to achieve a small particle size over the life of the product. The dilute hypochlorite substance preferably has about 125 ppm or less, with a pH of 5.5 adjusted with succinic acid, and/or hydrochloric acid. A particle size of the spray mist that is expelled from the spray bottle when the spray trigger is depressed is approximately 60 um, and preferably less than 120 um. The bottom 850 of the container 820 may be shaped as hemisphere with the base 830 as illustrated at FIGS. 8*a* and 8*b*, or may be petaloid with or without a base 830 as illustrated at FIGS. 8*c*, 8*d*, 8*e*, 8*f*, 8*g* and 8*h*. The preferred materials of the container 820 are PET or Polyethylene Naphthalate (hereinafter "PEN")/PET blend. The weight of the substance contained inside is approximately 9 to 20 ounces, or 12 to 14 ounces.

Ergonomics

Both the container 820 and the cap 810 have concave sidewalls that create a smaller relative diameter in the grip area 840 of the spray bottle, providing an adequate grip for consumers while avoiding an excessive reduction in the net content, and helping to keep the cost per oz of product at a reasonable level. Typically aerosols have a cylindrical shape and usually aerosol companies use wide diameter packages in order to increase the net content, which is recognized by the inventors herein to be very inconvenient for consumers from the ergonomic point of view, especially for people who generally have small hands.

The container 820 has a smaller diameter on the top than at the bottom. To achieve these proportions the sidewalls may have a radius of curvature range preferably from 500 mm to 900 mm. The bottle diameter in the grip area 840 has been found to be the most appropriate for an easy hold and it is between 20 mm and 70 mm. Another option to achieve these ergonomically convenient proportions for the bottle is to use truncated cone shaped sidewalls at an angle between 15 degrees and 75 degrees.

The cap 810 has a smaller diameter on the bottom compared with the top. To achieve these proportions the sidewalls of the cap 810 have a radius of curvature range from 500 mm to 900 mm. The diameter of the cap 810 in the grip area 840 is preferably between 20 mm and 70 mm, for permitting a best grip. Another option to achieve these ergonomically convenient proportions for the cap 810 is to use upside down truncated cone shaped sidewalls at an angle between 0 degrees and 10 degrees. The cap is described is further detail below with reference to FIGS. 12-14.

Permeation

The propellant fill pressure is preferably above 50 psi, and particularly around 100-170 or 200 psi. The pressure provides a fine mist spray, and compensates for loss of pressure over time and during the use of the product due to the expansion of headspace. In that regard, the headspace is preferably at least 30% and particularly around 50%. This minimizes pressure loss during use of the product due to the expansion, and to hold enough propellant to minimize the impact of loss of gas due to permeation through the plastic bottle, the valve and the valve crimp over the bottle.

Nitrogen is the preferred propellant due to its lower permeability through plastics like PET (vs other compressed and non flammable gases like $CO_2$ and air).

Although $CO_2$ has higher permeability through plastics, it can be an alternative due to its solubility in water based formulas, what creates a "gas reservoir" in the liquid phase that compensates the loss of propellant over time by being released from the liquid to the vapor phase to maintain corresponding equilibrium pressure.

Another alternative to reduce the permeability through PET is a process for the bottle manufacture that is called "heat-set". This process involves keeping the bottle molds warmer than in a traditional process, which slows down the cooling of the bottle and helps to increase the percentage of crystals in the plastic. PET, as with other poly-olefins which may be used as alternative container materials, is a two molecular structure material, i.e., having a crystalline and an amorphous phase. The crystalline structure provides a superior gas barrier than the amorphous one.

An advantageous solution to minimize the impact of loss of propellant is to use liquefied gases (e.g., hydro-fluoro-carbons (HFCs), hydrocarbons, dimethyl ether (DME), and other known to those skilled in the art). Liquefied gas-based aerosols maintain pressure notwithstanding permeation, because they keep the vapor pressure due to the liquid/vapor phase equilibrium. This application will also be possible for plastic aerosols when DOT approves the use of higher pressure non flammable propellants or flammable propellants for plastic containers larger than 4 floz.

Pressure Resistance

The preferred container design advantageously includes features that increase the internal pressure resistance and minimize deformation under extreme pressure and temperature conditions. This provides for the maintenance of the integrity of the plastic bottle. The concave side walls of a container in accordance with a preferred embodiment thus have a radius of curvature between 600 mm and 800 mm particularly to minimize deformation and visual detection of bulging.

A hemispherical shoulder such as that illustrated at FIG. 7*f* minimizes its vertical deformation. Such shoulder has a radius of curvature of around 26.25 mm. Another shoulder profile option that minimizes the vertical deformation and the stress in the walls due to internal pressure is a truncated cone, such as that illustrated at FIG. 7*b*, with an angle between 15 degrees and 75 degrees and a base diameter of between 20 mm and 80 mm, or between 50 mm and 60 mm.

Wall thicknesses in different areas found to resist the relevant pressure levels required are: at location below the shoulder, the minimum thickness preferably is 0.01 to 0.02 inch; at location halfway up the container, the minimum thickness preferably is 0.01 to 0.02 inch; at location 1 in above the bottom, the minimum thickness preferably is 0.01 to 0.02 inch.

The heat-set process described in the permeation section is advantageous for increasing the bottle pressure resistance as the crystalline phase has stronger mechanical properties than the amorphous one. Under these conditions, it is possible to have a plastic aerosol bottle above 12 floz, and foreseeably up to around 30 floz or more.

Figure 2:
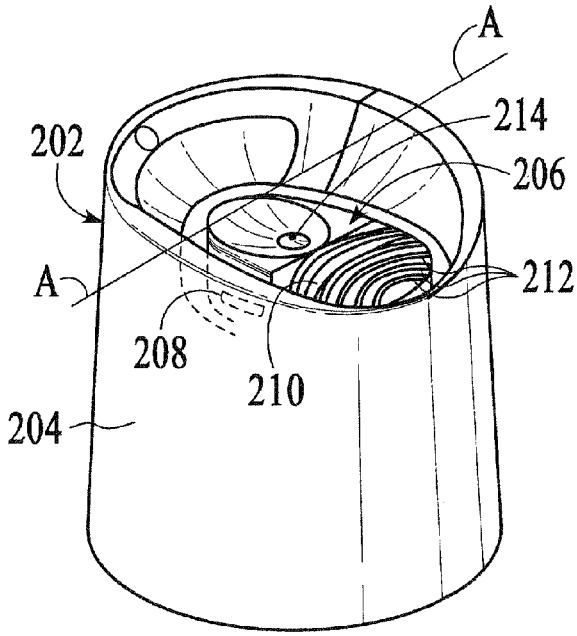
FIG.2 (PRIOR ART)
FIGS. 2 and 3 illustrates another conventional aerosol spray cap in perspective and cross-sectional side views, respectively.

Container bottom designs that may be used to handle pressure resistance requirements include hemispherical, petaloid, and champagne styles. The champagne style bottom is illustrated in FIG. 2 of PCT App. WO 03/097484 to Smith, which is incorporated by reference in its entirety. The petaloid style bottom is illustrated at FIGS. 8*c*-8*h*, and would preferably include three to six or more feet. These feet would also serve to maintain the spray bottle in an upright position even if no base section 830 were included. A base section 830 in accordance with the hemispherical style is illustrated at FIGS. 5, 6*b*-6*c*, 7*a*-7*f* and 8*b*.

Valve/Propellant

Figure 4:
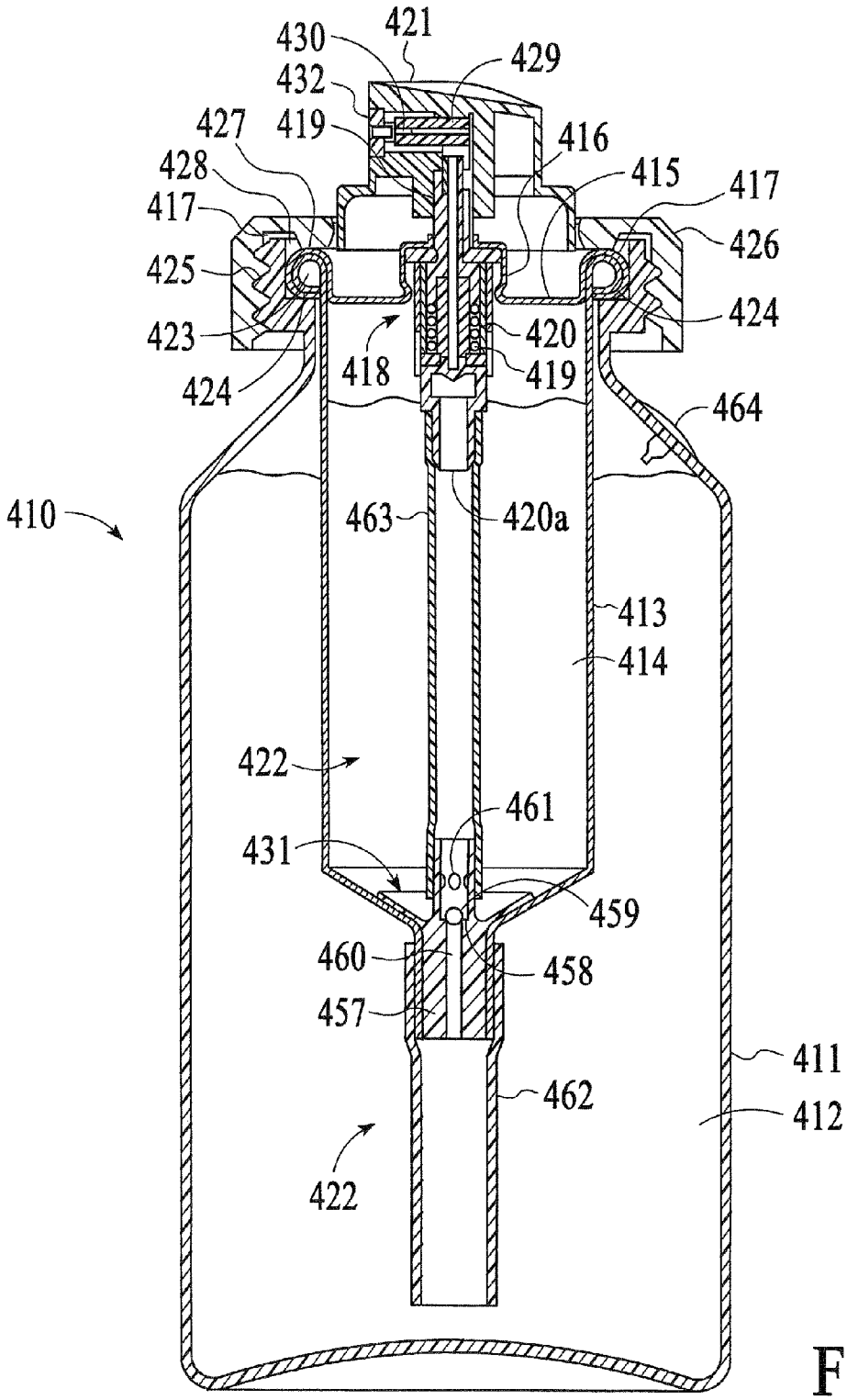
FIG.4 (PRIOR ART)
FIG. 4 shows a cross-sectional side view of another conventional aerosol spray bottle.

The spray bottle has internal structure that be substantially conventional, e.g., such as that illustrated at FIG. 4 or as described in any of the references cited herein, or as otherwise known to those skilled in the art. Materials for a valve stem and body may include polypropylene (PP). polyethylene (PE), polyethylene terephthalate (PET), polyethylene naphthalate (PEN), or blends thereof, glass filled PP or glass filled PE. Materials for stem and mounting cup gaskets may include fluoro-elastomers (e.g. Viton) or buna. The mounting cups may be formed of PP laminated metals (e.g. tinplate, aluminum, TFS), PE or PET laminated metals, micoflex coated metals, or fluoro-polymer coated metals. Materials for springs may be plastic, stainless steel 302 or 316, or nitronic stainless steel.

Propellants may include nitrogen, air, HFCs, or Hydrocarbons (propane, butane). The propellant may be used to create a fine mist spray of particle size between 50 micron and 120 micron. Nitrogen is a suitable propellant due to its low permeation through blow-molded plastic containers compared to other compressed and nonflammable gases like CO2 and air. As a compressed gas with low solubility in water based formulas, the internal pressure of nitrogen in the container is inversely proportional to the container headspace for a given propellant weight. As the product is being used, the headspace increases. Therefore, the pressure of the nitrogen gas decreases. Advantageously, when the initial headspace is between 30% to 50%, a fine mist and spray pattern performance during product use provides a particle size that remains less than 120 micron.

Comparison of FIG. 5 Designs

The designs illustrated at FIG. 5, i.e., the container 510, which is in accordance with a preferred embodiment, and the conventional container 520 are compared below. By at least three separate measures, the design of the container 510 is shown below to be superior to the conventional container 520 in their respective responses to internal pressure. These measures are (1) shape-change index, (2) percent increase in height, and (3) percent increase in volume, each in response to internal pressure. Results of test are summarized for these three features at FIGS. 9-11, respectively.

Some background for these tests follows. The method of finite-element-analysis (FEA) involves dividing a complex surface into thousands of quadrilaterals and triangles and then solving the stress strain relationships in matrix form. As mentioned, FIG. 5 provides a side-by-side visual comparison of a container 510 in accordance with a preferred embodiment, and a conventional design 520. The container 520 was obtained by converting the image in US published patent application No. 2004/0149781 into a 3D design in Pro/Engineer. The design was uniformly scaled in all three dimensions to be of the same volume as the container 510 of the preferred embodiment. The same thickness of 26 mils was used for the entire surface of both designs, except for the very top of the finish. Also, identical material properties were used for PET: 600 ksi (1 ksi=1000 psi) for Young's modulus and 20 ksi for the yield stress; which are estimated values for stretched PET obtained from a resin supplier. A value of 0.41 was used for Poisson's ratio.

The shape-change index is the average angular change of the surface and is a measure of how much the shape deforms with pressure or other stress. The smaller the value the less the shape changes in appearance. For example, a sphere maintains its shape when subjected to internal pressure even though it expands and so the value of the shape-change index remains at zero degrees in that case. It is advantageous to keep the shape-change index as small as possible to avoid unsightly changes with pressure and to minimize consumer-noticeable shape-changes during the life cycle of the product. The shape-change index is calculated by area-weighted-averaging of the change in normal direction of all the surface elements when subjected to a stress, like pressure.

The percent increase in height is a measure of how much the height changes with pressure. Values near zero are preferred over larger values since then the package remains consistent with the closure, label and case.

The percent increase in volume is a measure of how much the volume changes with pressure. Smaller values are preferred because any increase in volume will affect the size of the container and its relationship to the case and shelf. In addition, increase in volume means a proportionately greater increase in the headspace volume and corresponding decrease in pressure, thus potentially impacting the performance of the aerosol package.

Test Results

Figure 1:
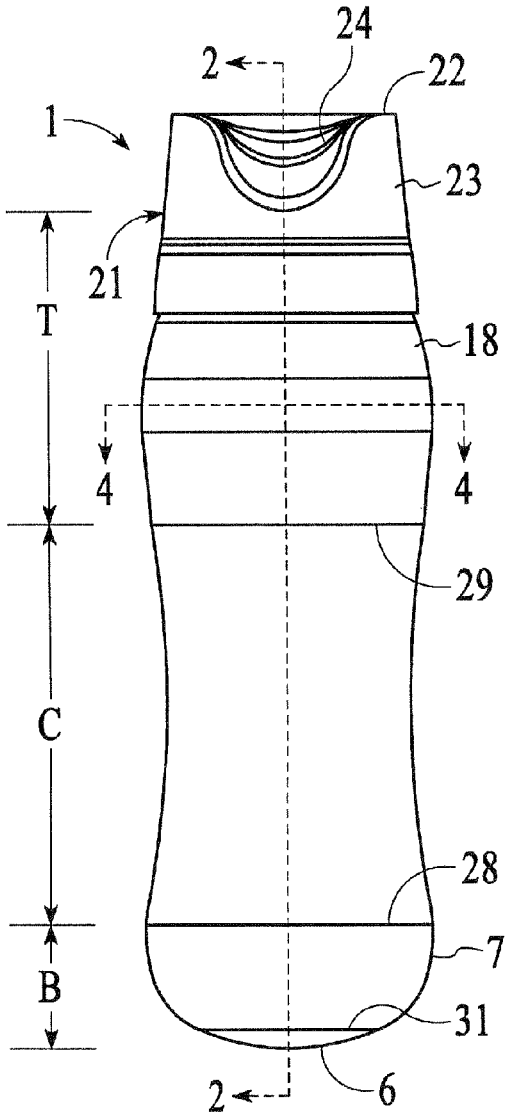
FIG.1 (PRIOR ART)
FIG. 1 illustrates a conventional aerosol spray container and cap.
Figure 9:
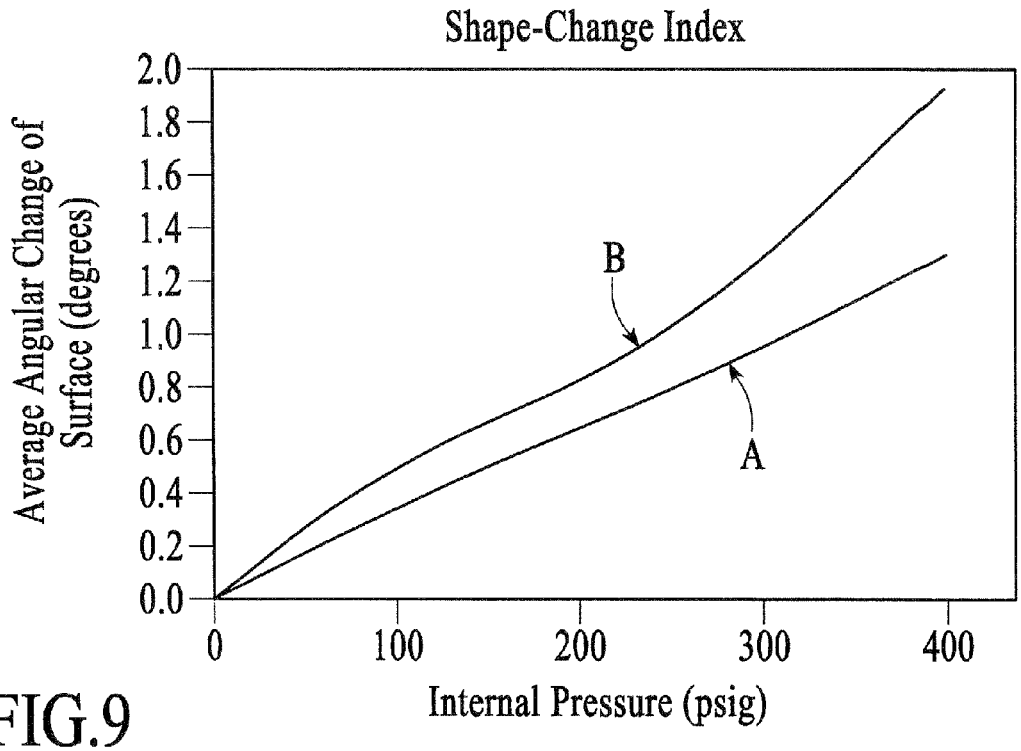
FIG. 9 shows plots of average change of surface angle in degrees versus internal pressure for the spray bottles illustrated at FIG. 5.

FIG. 9 compares the shape-change index for containers 510 and 520 illustrated at FIG. 5. As mentioned, container 510 is in accordance with a preferred embodiment, while container 520 is a conventional container. Note that the design 520 is also illustrated at FIG. 1, and the design 510 is also illustrated at FIGS. 6*a*-6*c*, 7*a*, and 8*a*-8*b*, while alternative shoulder designs are shown at FIGS. 7*b*-7*f* for the container 510. Everywhere from just above zero psi to 400 psi, the shape change index for container 510, shown as plot A in FIG. 9, is less than that for container 520, shown as plot B. That is, the shape of the container 510 deforms less with pressure than container 520 throughout this pressure range. Another feature of FIG. 9 is the that the difference in the shape change indices for the two containers 510 and 520 increases with higher pressure.

At 100 psi, the shape change index for the container 510 is about 0.3, while it is above 0.4 for the container 520. At 200 psi, e.g., the shape-change index for container 510, shown by plot A in FIG. 9, is less than 0.8 degrees, while the same is not true for the container 520 corresponding to plot B. It is preferred that the shape-change index be not more than 0.7 degrees at 200 psi. At 300 psi, the shape-change index for container 510, shown by plot A, due to pressure is less than 1.0 degree, while the same is not true for the container 520 shown by plot B. At 400 psi, the shape-change index for container 510 due to pressure is less than 1.4 degrees, while the same is not true for the container 520 at the same 400 psi pressure, as illustrated by FIG. 9.

Figure 10:
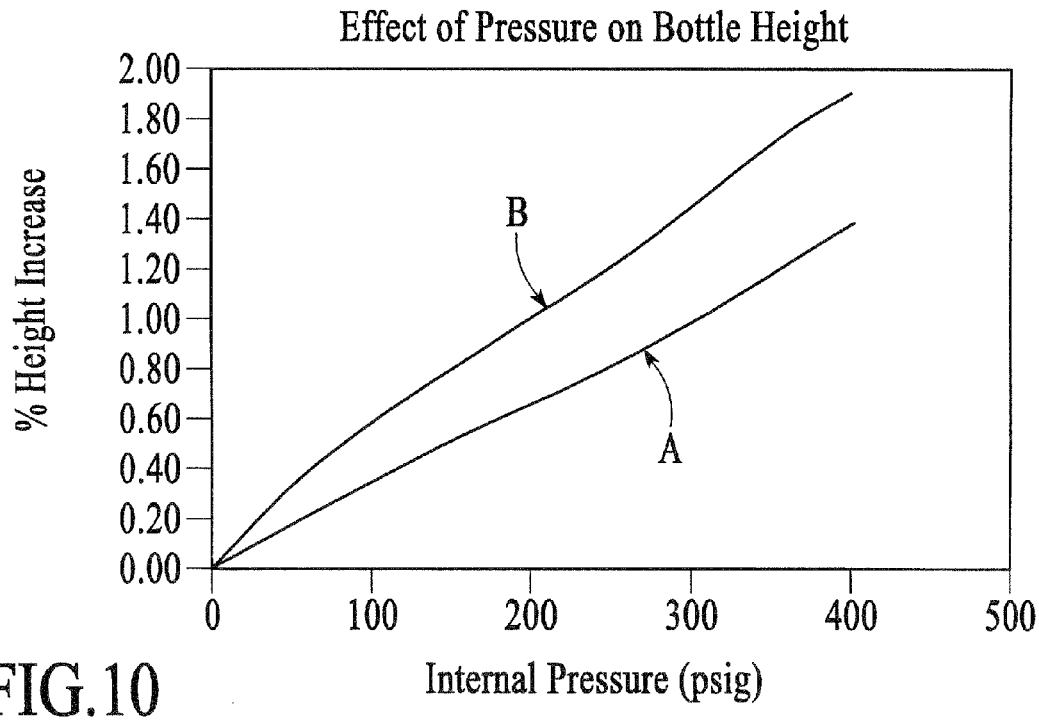
FIG. 10 shows plots of percent height increase versus internal pressure for the spray bottles illustrated at FIG. 5.

FIG. 10 compares the percent increase in height for the two containers 510 and 520 of FIG. 5. Here again, the container 510, which is in accordance with a preferred embodiment, presents less of an increase in height than the conventional container 520. Thus, the container 510 is advantageous from a packaging standpoint compared with container 520.

Just as with FIG. 9, everywhere from just above zero psi to 400 psi, the % height increase for container 510, shown as plot A in FIG. 10, is less than that for container 520, shown as plot B. That is, the height of the container 510 grows less as a pressure-induced deformation than container 520 throughout this pressure range. Another feature of FIG. 10 is the that the difference in the % height change for the two containers 510 and 520 increases with higher pressure.

At 100 psi, the percent increase in height of the container 510 due to pressure is about 0.3%, while the same is not true for container 520. At 200 psi, the percent increase in height for container 510 is 0.7% or slightly less as illustrated by plot A of FIG. 10, while the same is not true for container 520 according to plot B of FIG. 10. At 300 psi, the percent increase in height of the preferred container 510 due to pressure is not more than 1.1%, while the same is not true for container 520. At 400 psi, the percent increase in height of the container 510 due to pressure is less than 1.5%, while the same is not true for the container 520.

FIG. 11 compares the percent increase in volume for the container 510, which is in accordance with a preferred embodiment, with that for the conventional container 520. Although the effect is small, FIG. 11 does show that the container 510 is once again slightly better than the container 520 on this point.

At 100 psi, the % volume increase is shown to be about 1.4% for the container 510. At 200 psi, the % volume increase is about 3% or less. At 300 psi, the % volume increase is about 4.3%. At 400 psi, the % volume increase is less than about 6% or less.

In summary, using the well-accepted method of finite element analysis, a container 510 in accordance with a preferred embodiment is shown to provide a significant functional advantage over conventional container 520, in terms of shape-change index, percent height increase, and percent volume increase.

Cap

Figure 3:
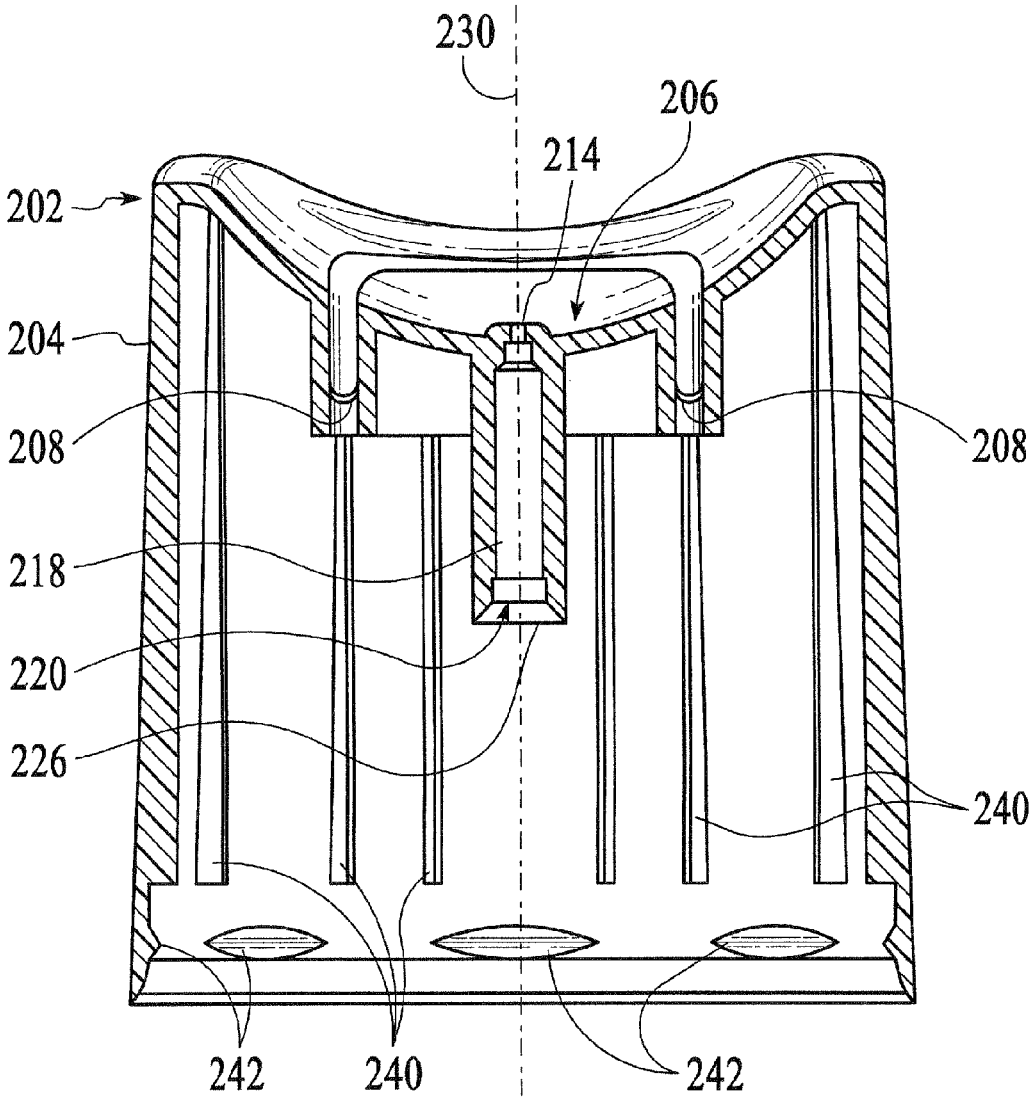
FIG.3 (PRIOR ART)

Referring now to FIG. 12, in order to achieve an advantageous cap shape and proportions, a two piece approach is provided and illustrated. The cap 900 includes a "skirt" 930 that snaps with the container 920 and a "lid" 910 that is snapped on the skirt 930 and that preferably includes spray channels such as those illustrated at FIG. 3. The aerosol cap 900 that is molded in two pieces also includes an outward slant (from bottom to top), whereas traditional aerosol caps include only one piece. The two-piece cap can have a more intricate shape than the one piece cap. The skirt of the aerosol cap may have a concave curvature. The concave curvature may have a radius of curvature between 500 mm and 900 mm. The cap may have a diameter at its junction with the container that is smaller than an opposing diameter at the top of the spray bottle. The diameters of the cap may be between 20 mm and 80 mm. In one embodiment, the walls of the cap comprise an upside-down truncated cone shape.

Referring to FIG. 13, the actuator 900, and more specifically finger pad 940, is wide, smooth, and concave for ergonomic use. This concave curvature provides an intuitive and natural indication about were the finger should be placed (in the center according to the horizontal axis from a rear view) to minimize the actuation force of the cap. The concave radius of curvature is preferably between 7 mm and 160 mm and is being used in the finger pad/actuator, according to the horizontal axis from a rear view (side to side).

Figure 14:
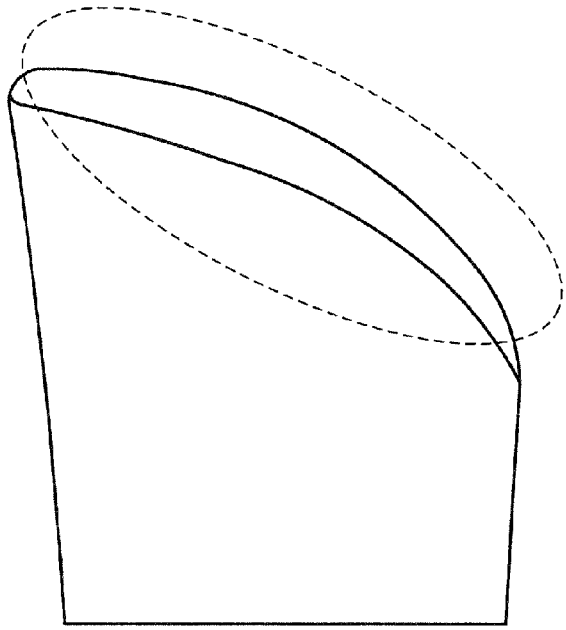
FIG. 14 shows a side view of the cap of FIG. 13.

Referring to FIG. 14, in order to provide convenient ergonomics for the actuation of the cap 900, its top profile preferably from a side view has a convex shape with a radius of curvature preferably between 25 mm and 310 mm. This profile facilitates a natural rest area for the finger.

In order to further provide very convenient ergonomics for the actuation of the cap 900, FIG. 14 shows that its front side (on the left in FIG. 14) is taller than its rear (on the right in FIG. 14) by between 3.2 mm and 64 mm. These proportions create a natural "rest" area for the finger. An alternative way to achieve this benefit is to create the top surface of the cap and the finger pad/actuator with a substantially flat exposed surface at downward angle between 10 degrees and 60 degrees to horizontal from the front to the rear of the cap when the bottle is mounted upright.

To improve the ergonomics of the finger pad of the spray trigger, a double injection molded piece on top of it can also be used. Another alternative is a post-molding operation to adhere rubber material of foam material on the finger pad. This enables the use of a softer material on the top surface of the finger pad than on the remainder of the finger pad, which improves the comfort and reduces the stress on the fingers during actuation.

A spray bottle/container in accordance with a preferred or alternative embodiment can deliver a wide range of actives including dilute hypochlorite, e.g., surfactants, buffers, fragrances, anti-allergen compounds, other air disinfectants, and/or deodorizing compounds. This technology is also advantageous in the personal care area or as air fresheners, or otherwise to deliver incompatible ingredients.

The present invention is not limited to the embodiments described above herein, which may be amended or modified without departing from the scope of the present invention, which is as set forth in the appended claims and structural and functional equivalents thereof. In addition, all references cited above herein, in addition to the background and summary of the invention sections, are hereby incorporated by reference into the detailed description of the preferred embodiments as disclosing alternative embodiments.

What is claimed is:

1. A cap for coupling with a pressure-resistant container to form an aerosol spray bottle, the cap comprising a cap skirt and a cap lid that is snapped on the cap skirt, the cap further including a spray trigger having a finger pad for controlling a valve, the container having a pressurized substance therein and defining a valve-sealed opening for selectively releasing the pressurized substance from the container by actuating the spray trigger to open the valve, wherein the cap has a cap top where the cap skirt meets the cap lid and a cap bottom at a distal end of the cap skirt where the cap couples with the container, the cap skirt having a continuous outward slant from the cap bottom to the cap lid, wherein the cap is configured such that the cap has a diameter at the cap bottom that is smaller than an opposing diameter at the cap lid.

2. An aerosol spray bottle having a top with a top profile and a bottom comprising:

a. a two-piece cap comprising a cap skirt with exposed outer walls and a cap lid that is snapped on the cap skirt and the cap coupled to a pressure-resistant plastic container, the cap further including a spray trigger for controlling a valve;

b. wherein the cap has a cap top where the cap skirt meets the cap lid and a cap bottom at a distal end of the cap skirt where the cap couples with the container, the cap skirt having a continuous outward slant from the cap bottom to the cap lid;

c. the pressure-resistant plastic container having a pressurized substance therein and defining a valve-sealed opening for releasing the substance from the container by opening the valve by actuating the spray trigger;

d. wherein the cap has a diameter at the cap bottom that is smaller than an opposing diameter at the cap lid.

3. The aerosol spray bottle of claim 2, wherein both said diameters of the cap are between 20 mm and 70 mm.

4. The aerosol spray bottle of claim 2, wherein the skirt of the cap has a concave curvature.

5. The aerosol spray bottle of claim 4, wherein the concave curvature has a radius of curvature between 500 mm and 900 mm.

6. The aerosol spray bottle of claim 4, wherein the cap is configured such that the cap has a diameter at its bottom that is smaller than an opposing diameter at the top of the cap.

7. The aerosol spray bottle of claim 2, wherein the top profile of the cap from a side view has a convex shape.

8. The aerosol spray bottle of claim 7, wherein the convex shape has a radius of curvature between 25 mm and 310 mm.

9. The aerosol spray bottle of claim 2, wherein walls of the cap comprise an upside-down truncated cone shape.

10. The aerosol spray bottle of claim 2, wherein the cap has a front side where the substance is expelled that is between 3.2 mm and 64 mm higher than the back side where a user's finger would be when the user actuates the trigger with a fingertip.

11. The aerosol spray bottle of claim 2, wherein the spray trigger is disposed adjacent to the cap top opposite the junction of the cap with the container, and the spray trigger comprises a substantially flat exposed surface at downward angle between 10 degrees and 60 degrees to horizontal from the front to the rear of the cap when the bottle is mounted upright.

12. The aerosol spray bottle of claim 2, wherein the spray trigger is disposed at the cap top and the spray trigger comprises a concave exposed surface.

13. The aerosol spray bottle of claim 12, wherein the concave exposed surface has a radius of curvature between 7 mm and 160 mm.

14. The aerosol spray bottle of claim 2, wherein the finger pad of the spray trigger has a softer material on the top surface than on the remainder of the spray trigger.

* * * * *